United States Patent [19]

Kline

[11] 3,965,718

[45] June 29, 1976

[54] TRANSFER MECHANISM

[75] Inventor: Gaylen O. Kline, Tiffin, Ohio

[73] Assignee: The National Machinery Company, Tiffin, Ohio

[22] Filed: Nov. 18, 1974

[21] Appl. No.: 524,531

Related U.S. Application Data

[63] Continuation-in-part of Ser. No. 381,851, July 23, 1973, abandoned.

[52] U.S. Cl. ..... 72/405; 10/12 T

[51] Int. Cl.[2] ..... B21J 13/10

[58] Field of Search ..... 72/405; 10/12 T, 11 T, 10/76 T, 166

[56] References Cited

UNITED STATES PATENTS

| | | | |
|---|---|---|---|
| 2,124,113 | 7/1938 | Kaufman | 10/12 T |
| 2,736,909 | 3/1956 | Hatebur | 10/76 T |
| 3,165,766 | 1/1965 | Wisebaker | 10/12 T |
| 3,259,929 | 7/1966 | Van De Meerendonk | 10/76 T |
| 3,604,242 | 9/1971 | Allebach | 10/12 T |
| 3,685,070 | 8/1972 | McClellan et al. | 10/12 T |

FOREIGN PATENTS OR APPLICATIONS

| | | | |
|---|---|---|---|
| 1,232,097 | 1/1967 | Germany | 72/405 |

*Primary Examiner*—Lowell A. Larson

*Attorney, Agent, or Firm*—McNenny, Pearne, Gordon, Gail, Dickinson & Schiller

[57] ABSTRACT

A transfer for a forging machine is disclosed which is operable to progressively transfer workpieces laterally between spaced die stations on a die breast of the machine. The transfer mechanism includes first and second assemblies, each including transfer arms which are positioned on either side of the die stations closely adjacent to the plane of the die breast. The transfer arms are mounted for arcuate movement about parallel axes to provide opening and closing. Lengthwise movement of the arms is provided for the transfer of a gripped part and for return of the grippers. Each transfer arm carries workpiece grippers having finger end portions operable to grip workpieces at each die station as the transfer arms are translated toward each other. Guides are provided to cause the finger end portions of the workpiece grippers to follow paths substantially parallel to the plane of the die breast. In one illustrated embodiment the assemblies are pivoted on axes which are parallel to the face of the die breast and in another illustrated embodiment the assemblies are pivoted on axes perpendicular to the face of the die breast.

31 Claims, 5 Drawing Figures

TRANSFER MECHANISM

This is a continuation in part of my pending application for U.S. Pat., Ser. No. 381,851, filed July 23, 1973, now abandoned.

PRIOR ART

This invention relates generally to automatic forging machines for progressively forming blanks and, more particularly, to a novel and improved transfer for such machines. Various types of forging machines are provided to progressively form parts at a plurality of die stations. In a hot forging machine heated blanks are fed to the die breast of a machine and are sequentially transferred to a plurality of die stations in which they are progressively formed to the desired shape. A transfer mechanism for a forging machine is set forth in U.S. Pat. No. 2,124,113 to Kaufman. That patent discloses a transfer mechanism which includes a slide bed movable along the die breast surface and carrying a plurality of work gripping fingers. The slide bed is shifted between work station in timed relationship with movement of the forging ram toward and away from the die stations and the work gripping fingers are opened by cams which are responsive to ram movement toward the die stations.

Although such transfer mechanisms are suitable for use in transferring workpieces between die stations on a multiple die, cold-forming machine, they are not entirely suitable for transferring workpieces between die stations on multiple die, hot-forming machines, since the transfer mechanisms are subjected to the harmful effects of scale, heat, and coolant in the die area. It is therefore desirable to provide a transfer mechanism for use on multiple die, hot-forming machines which does not include mechanisms directly associated with the surface of the die breast. Such a transfer mechanism is shown in U.S. Pat. No. 2,736,909 and includes two substantially right-angularly bent nipper arms secured to a pair of shafts locateed on opposite sides of the face of the die breast and parallel thereto. The shafts are rotated in opposite directions to move the nipper arms toward and away from each other so that the nipper arms may grasp blanks in the free space in front of the dies, and the shafts are then translated longitudinally with respect to their axes to transfer the blanks from one die station to another. The shafts are positioned in locations which are relatively remote with respct to the face of the die breast, so that the arc traversed by the work gripping ends of the nipper arms clears the cooperating forming dies as the shafts are rotated. This arrangement imposes relatively large torsional loads on the shafts. More important, however, is the fact that the work gripping ends of the nippers do traverse an arc, thus necessitating increased header slide movement and/or the use of longer and more slender die-cooperating tools to provide clearance for the above-described arcuate travel.

SUMMARY OF THE INVENTION

The present invention is directed to an improved transfer mechanism having its support and driving linkages remote from and not operatively associated with the face of the die breast, to thus minimize the harmful effects of heat, coolant, and scale on the support and driving mechanism. While accomplishing this objective, the invention provides a transfer mechanism wherein cooperating work gripping fingers travel in a substantially planar manner toward and away from the workpiece to permit close spacing of the cooperating dies.

In accordance with this invention, a pair of elongated arms are cantilever supported at a position spaced from the die stations for lengthwise movement in a direction of transfer. Grippers are provided on the free end sections of the arms and are opened and closed by lateral movement of the free ends of the arms. The movement of the grippers back and forth between the die stations is accomplished by lengthwise or longitudinal movement of the arms in the direction of transfer.

The mechanism for supporting and moving the arms is located at one side of the die breast and is enclosed sufficiently to prevent contamination by coolant or scale or the like and to prevent harmful effects of heat.

In one illustrated embodiment, the tranfer includes first and second transfer arms which are positioned on either side of the die stations closely adjacent to the plane of the die breast for arcuate translation about parallel shafts which are parallel to and spaced from the plane or face of the die breast. Each transfer arm carries workpiece grippers having finger end portions operable to grip workpieces at each die station as the transfer arms are translated toward each other. Although the transfer arms traverse arcs, guide are provided to cause finger end portions of the workpiece grippers to follow paths substantially parallel to the plane of the die breast to permit close spacing of the cooperating tools and dies. Since the transfer arms are positioned close to the plane of the die breast, there are no substantial torsional loads imposed thereon. The fingers are driven toward and away from the workpieces in timed relationship to the reciprocation of the cooperating die members so that a workpiece is gripped when the forming dies are separated. The transfer arms are axially reciprocated so that workpieces picked up at one die station may be transferred by the workpiece grippers to an adjacent die station. This operation also takes place in times relationship to the cooperating dies so that translation takes place when the forming dies are separated.

In a second embodiment of this invention, a pair of opposed transfer assemblies each include a support member mounted at its end remote from the die breast for pivotal movement about an axis perpendicular to the die face and parallel to the pivot of the other assembly. Mounted on each support member is an elongated transfer arm which is lengthwise movable relative to its support member. Each arm is provided with a free end or cantilever section which extends to a position adjacent to the die stations on which grippers are mounted. Pivotal movement of the assemblies causes lateral movement of the free ends of the arms to open and close the grippers. The movement of the grippers back and forth between the die stations is provided by the lengthwise movement of the arms. The structure is arranged so that the lengthwise movement of the arms is parallel during workpiece transfer. Therefore, such movement does not produce any opening or closing of the grippers.

According to an important aspect of this invention, the mechanisms employed to support and actuate the transfer arms are housed and are substantially isolated from the die breast to minimize contamination of bearings and oil from the harmful effects of heat, coolant, and scale in the die area.

A drive and support arrangement is provided to move each transfer arm through its arcuate translation in a direction opposite the translation of the other arm. This arrangement includes the parallel pivots about which the transfer arms are arcuately translated and a drive linkage is connected to drive each transfer arm toward and away from each other. The finger end portions are guided in a plane substantially parallel to the plane of the die breast. The transfer arms are also slidably carried by the pivoted supports so that they may be axially shifted therein when a workpiece is gripped to transfer a workpiece to an adjacent die station.

According to a further aspect of this invention, the finger end portions on one transfer arm are spring-biased so that they may spread apart upon engagement of a workpiece. By permitting the finger end portions to resiliently engage a workpiece, minor variations in workpiece configuration may be accommodated. Since such finger end portions are spring-biased, simultaneous release of the finger end portions gripping a workpiece would tend to drive the workpiece away from the spring-biased fingers and might cause improper alignment of the workpiece in its die. Therefore, the scissors mechanism according to this invention is designed so that the spring-biased finger end portions are released prior to release of the other cooperating finger end portions, thus permitting the workpiece to be backed by the subsequently released finger end portions as the spring-biased portions are released.

DETAILED DESCRIPTION OF THE INVENTION

Figure 1:
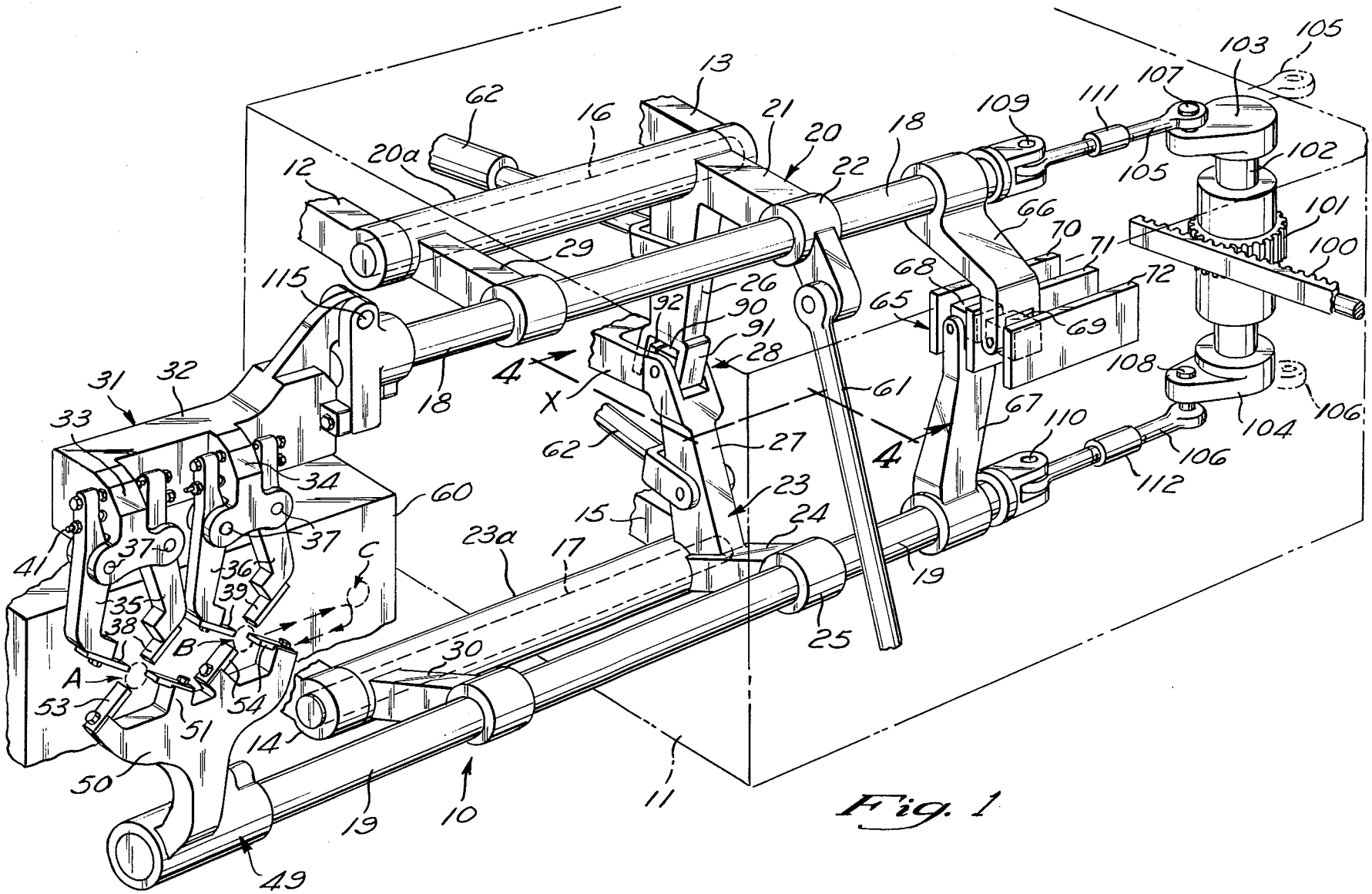
FIG. 1 is a perspective view of a transfer mechanism according to a first embodiment of this invention, with certain portions broken away or omitted for clarity.

Referring now to FIGS. 1 to 4 of the drawings, the illustrated machine is particularly suitable for transferring workpieces, such as nuts, sequentially from one die station to an adjacent die station of a hot forging machine. As will be explained in greater detail, the mechanism is operated in by the forging machine in a timed relationship to actuation to its forging dies. A transfer arm mechanism 10 according to this invention includes a housing 11 having a plurality of projecting arms 12, 13, 14, and 15 fixed thereto. Rigidly connected between the arms 12 and 13 is a stationary shaft 16 and, similarly, a stationary shaft 17 is connected between the arms 14 and 15 and is parallel to the shaft 16.

A pair of parallel transfer arms 18 and 19 are provided and these arms are mounted parallel to the shafts 16 and 17 for arcuate movement about these shafts. The mounting means which provides such arcuate movement comprises a first support member or bell crank 20 having a hollow sleeve 20a rotatably mounted on the shaft 16 and having one arm 21 pivotally and slidably carrying the transfer arm 18 in a bushing 22. A second support member or bell crank 23 has a hollow sleeve 23a rotatably mounted on the shaft 17 and has one arm 24 pivotally and slidably carrying the transfer arm 19 in a bushing 25. Other arms 26 and 27 of the bell cranks 20 and 23, repectively, are joined together at a connection 28. Further support for the transfer arms 18 and 19 is provided by links 29 and 30, which are integral with and respectively extend from the sleeves 20a and 23a. The link 29 is pivotally and slidably associated with the transfer arm 18 at its distal end and, similarly, the link 30 is pivotally and slidably associated with the transfer arm 19 at its distal end.

One end of each transfer arm 18 and 19 carries a means for gripping a workpiece at a die station and for transferring that workpiece to an adjacent die station. Such means comprises a first gripper assembly 31 fixed to the free or cantilever end of the transfer arm 18 and a cooperating second gripper assembly 49 fixed to the free or cantilever end of the transfer arm 19. The gripper assembly 31 comprises a block 32 have projecting portions 33 and 34 associated therewith. Finger tongs 35 and 36 are respectively pivotally connected to the portions 33 and 34 by pivot pins 37. The finger tongs 35 and 36 are provided at one end with finger end portions 38 and 39, respectively, and the ends of the finger tongs 35 and 36 carrying those finger end portions are biased together by a mechanism shown most clearly in FIG. 2.

Figure 2:
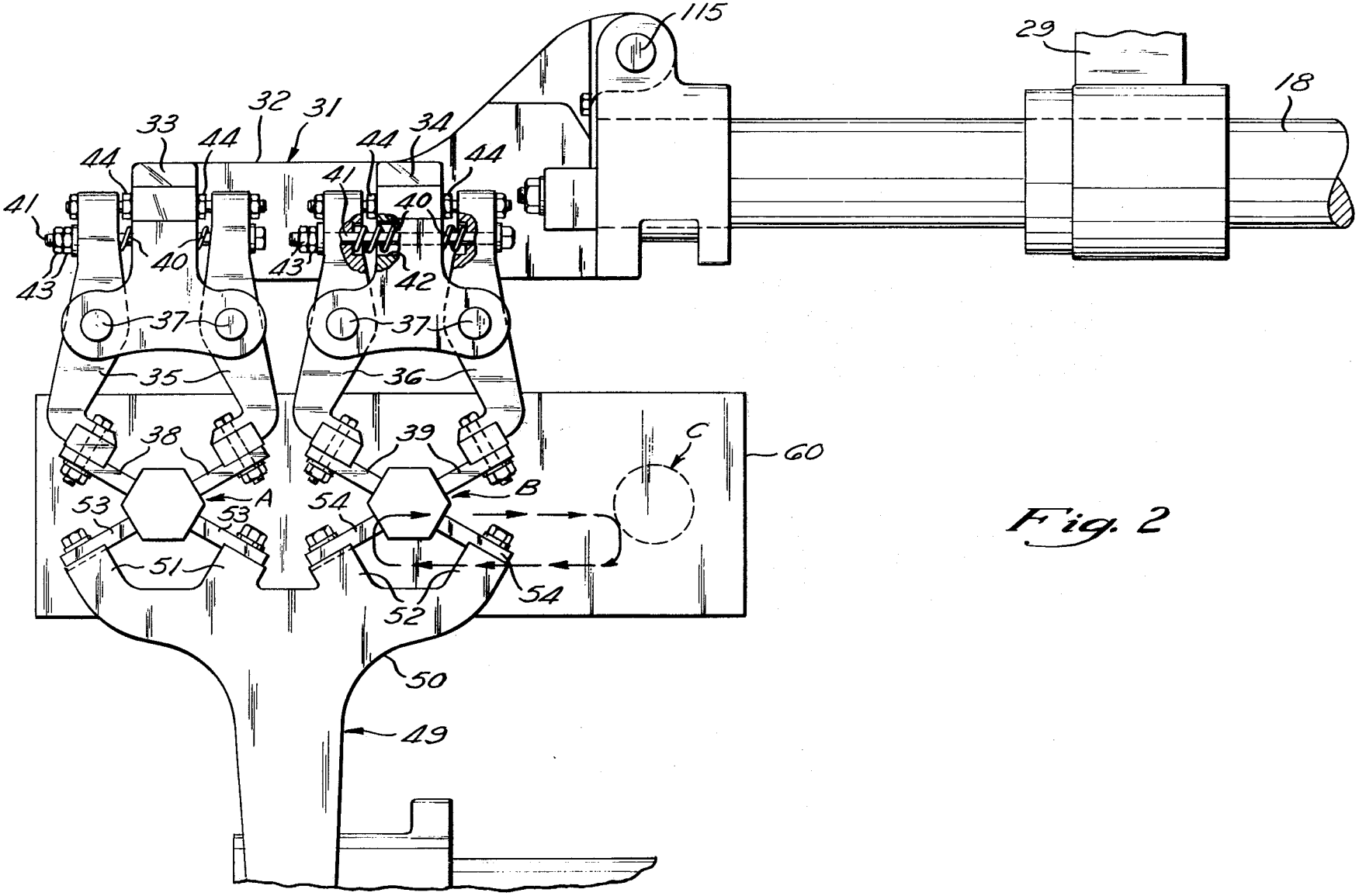
FIG. 2 is a fragmentary plan view of the finger end portions of the transfer arms, showing the path of travel of the finger end portions across a die breast, with portions broken away to show details of construction.

Referring now to FIG. 2, the other ends of the finger tongs 35 and 36 are biased apart by compression springs 40, which encircle guide bolts 41. Each guide bolt 41 and its associated compression spring 40 extend through a passageway 42 in each projecting portion 33 and 34, and each guide bolt 41 is slidably received in the finger tongs 35 and 36 so that each compression spring 40 biases the upper ends of the finger tongs 35 and 36 apart. Lock nuts 43 are provided at the ends of each guide bolt 41 to limit the inward movement of the finger end portions 38 and 39. Outward movement of the finger end portions 38 and 39 is limited by stop bolts 44, which are adapted to engage the projecting portions 33 and 34.

The gripper assembly 49 includes a plate 50 which is fixed to the transfer arm 19 and which has two pairs of projecting finger tongs 51 and 52. The finger tong 51 has finger end portions 53 fixed thereto and, similarly, the finger tong 52 has a pair of finger end portions 54 fixed thereto. As is illustrated in the drawings, the finger end portions 38, 39, 53, and 54 are adapted to grip hexagonal nut blanks. It should be appreciated, however, that these finger end portions may be modified to grip other differently shaped objects.

The workpiece gripper assemblies 31 and 49 are moved toward and away from each other to grip and release workpieces at die stations. As was previously indicated, the transfer arms 18 and 19 travel through arcuate paths about the axes of the shafts 16 and 17, but the finger end portions 38, 39, 53, and 54 are guided in a plane which is substantially parallel to the plane of a die breast 60. The transfer arms 18 and 19 are driven through their arcuate travel by a connecting rod 61 which is pivoted to an extension of the bell crank 20. The connecting rod 61 is driven by a suitable cam (not shown) in timed relationship to the opening and closing movements of the forging dies. As the dies are opened, the rod 61 is caused to move downwardly, as viewed in FIG. 1, to cause the transfer arm 18 to traverse an arc about the shaft 16 and to thereby advance the finger end portions 38 and 39 toward workpieces positioned at die stations A and B. The transfer arm 19 is also caused to traverse an arc about the shaft 17 to advance the finger end portions 53 and 54 toward the workpieces at die stations A and B because of the connection 28 between the bell cranks 20 and 23. After transferring the workpiece located at the die station A to the die station B, and simultaneously transferring the workpiece from the die station B to a die station C in a manner which will hereinafter be explained, the rod 61 is caused to move upwardly, as viewed in FIG. 1, to release the workpieces prior to the next die operation.

Since the connecting rod 61 is cam-actuated, it is desirable to provide spring-biased rods 62 which are pivotally connected at one end to the bell cranks 20 and 23 and at their other ends to the housing 11. The rods 62 bias the transfer arms and the work grippers toward a work-engaging position so that the connecting rod 61 will maintain engagement with its cam.

The finger end portions 38, 39, 53, and 54 are guided in a plane substantially parallel to the plane of the die breast 60 by a finger guide assembly 65. The assembly 65 includes arms 66 and 67 which are respectively fixed at one end to the transfer arms 18 and 19 and which are pivotally connected to guide blocks 68 and 69 at their other ends. The guide blocks 68 and 69 are slidably received between adjacent and parallel plates 70, 71, and 72. The plates 70, 71, and 72 are fixed to the housing 11 by fastening means (not shown) so that their guide surfaces are parallel to the plane of the die breast 60 and so that the guide blocks 68 and 69 are guided in planes which are closely adjacent the plane of the die breast 60. It may now be appreciated that as the transfer arms 18 and 19 traverse arcs about the shafts 16 and 17, the finger guide mechanism 65 causes the transfer arms 18 and 19 to rotate in opposite directions about their axes to cause the finger end portions to follow substantially straight-line paths parallel to the plane of the die breast 60.

Figure 3:
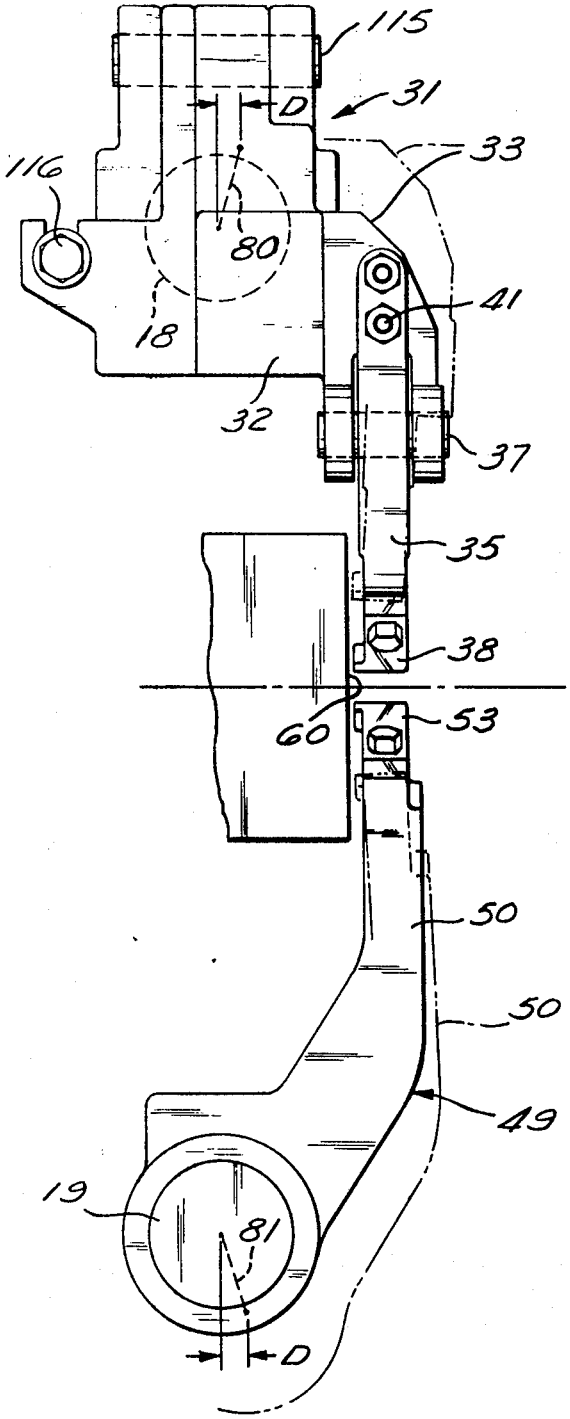
FIG. 3 is an end view of the transfer arms and associated finger end portions, showing movement of those portions toward and away from each other.
Figure 4:
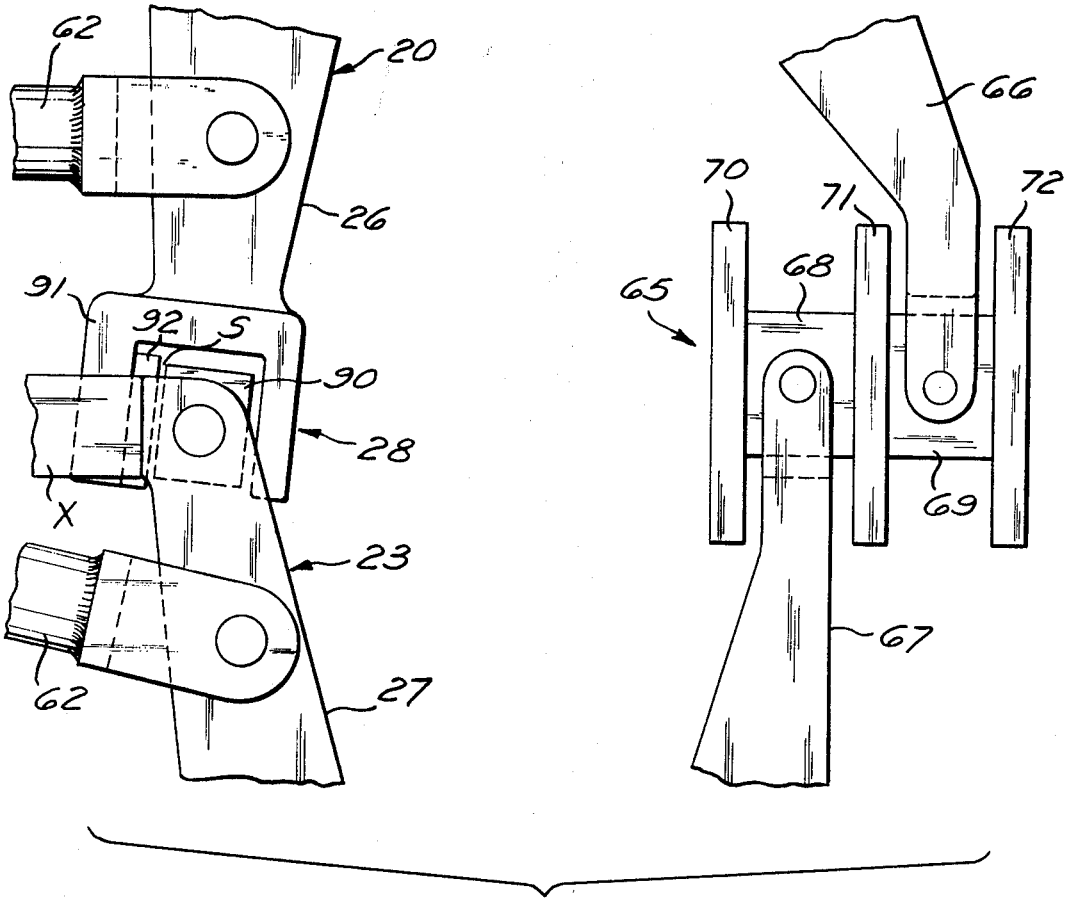
FIG. 4 is a fragmentary view illustrating the scissors mechanism for operating the transfer arms and the guide mechanism for the finger end portions, the plane of the view being indicated by the line 4—4 in FIG. 1.

The movement of the finger end portions may be appreciated by reference to FIG. 3. In that figure, the solid outline position of the gripper assemblies 31 and 49 indicates a workpiece-engaging condition and the phantom line position indicates a disengaged condition. In moving from the engaged to the disengaged condition, the transfer arms are pivoted about the shafts 16 and 17 in a counterclockwise and clockwise direction, respectively, and traverse arcs 80 and 81, respectively. This arcuate traversal results in a transfer arm offset corresponding to the distance D, and, if the finger end portions were not guided in the manner set forth herein, those finger end portions would also be offset a distance greater than D from the plane of the die breast 60 and would necessitate modifications to the forging tools and dies and/or the header slide to provide necessary clearance. However, as the transfer arms 18 and 19 are translated the arces 80 and 81 in a counterclockwise and clockwise direction, respectively, the transfer arms 18 and 19 are caused to rotate in a clockwise and counterclockwise direction, respectively, by the guide mechanism 65 to cause the finger end portions to travel in substantially planar alignment with the face of the die breast.

It should be noted that the transfer arms 18 and 19 are positioned relatively near the plane so that torsional loads and gripper deflection are minimized.

As was previously indicated, the finger end portions 38 and 39 are biased toward each other to accommodate variations in the workpieces. To minimize any tendency for the end portions 38 and 39 to spring together and thereby displace the workpieces upon release thereof, a mechanism is provided to slightly retard the release of the finger end portions 53 and 54 so that they will back up the workpieces during the prior release of the finger end portions 38 and 39. This result is accomplished by the connection 28. As may be seen most clearly in FIG. 4, the connection 28 includes a block 90 pivotally connected to the end of the arm 27 and which is received within a U-shaped end portion 91 of the arm 26. With the finger end portions out of engagement with their workpieces, the block 90 is in face-to-face engagement with a check block 92. As the finger end portions 53 and 54 engage the workpiece and as the arm 27 simultaneously contacts a stationary stop X, the bell crank 20 is moved a small increment relative to the bell crank 23 so that a space S is provided between the block 92 and the block 90. This space corresponds to the movement of the transfer arm 18 during the spreading of the finger end portions 38 and 39. Thus, when the transfer arms 18 and 19 are released from the workpieces, the bell crank arm 20, and therefore the finger end portions 38 and 39, will be moved prior to movement of the bell crank 23 to permit the spring loaded finger end portions 38 and 39 to be released from the workpieces prior to the release of the finger end portions 53 and 54.

After engagement of workpieces at die stations A and B, the workpiece at station A is carried to station B and the workpiece at station B is simultaneously carried to station C by a mechanism which will now be explained.

After engagement of the finger end portions 38, 39, 53, and 54, a gear rack 100 is driven axially by a suitable cam or the like in timed relationship to movement of the rod 61 so that the rack 100 is driven after the finger end portions are closed and after they are opened to return the finger end portions to the die stations A and B.

The gear rack drivingly engages a spur gear 101 which is mounted on a cross shaft 102. Fixed to the ends of the cross shaft 102 is a pair of crank arms 103 and 104. A pair of connecting rods 105 and 106 is respectively pivotally connected to the crank arms 103 and 104 by self-aligning bearings 107 and 108. the other end of each rod 105 and 106 is respectively connected to the transfer arms 18 and 19 by self-aligning bearings 109 and 110. To provide for proper positioning of the finger end portions relative to the die stations, the rods 105 and 106 may be split and threaded into couplings 111 and 112. When the crank arms 103 and 104 drive the rods 105 and 106 to the position indicated in phantom outline in FIG. 1, the transfer arms 18 and 19 are axially retracted to cause the finger end portions to transfer workpieces to adjacent die stations. The finger end portions are then opened in the previously described manner to release the workpieces in the adjacent stations. It should be noted that the self-aligning bearings 107-110 permit the arms 18 and 19 to move arcuately relative to the crank arms 103 and 104. It should also be noted that during axial movement of the arms 18 and 19, the blocks 68 and 69 slide axially along the plates 70-72. After the finger end portions are opened, they are then advanced by reversing the movement of the rack 100 to axially advance the transfer arms to the position illustrated in solid outline in FIG. 1. The finger end portions are then closed and the operation is repeated. The opening, closing, retraction, and advancement of one of the finger end portions 54 are indicated by the arrows in FIGS. 1 and 2, and it should be appreciated that the other finger end portions follow similar paths.

In order to gain access to the die face 60 for maintenance or repairs, the block 32 and its associated mechanisms may be swung away from the die face. This is accomplished by providing a hinged connection 115 between the block 32 and the transfer arm 18. These members are held together by a bolt 116 (FIG. 3) during operation of the transfer.

Figure 5:
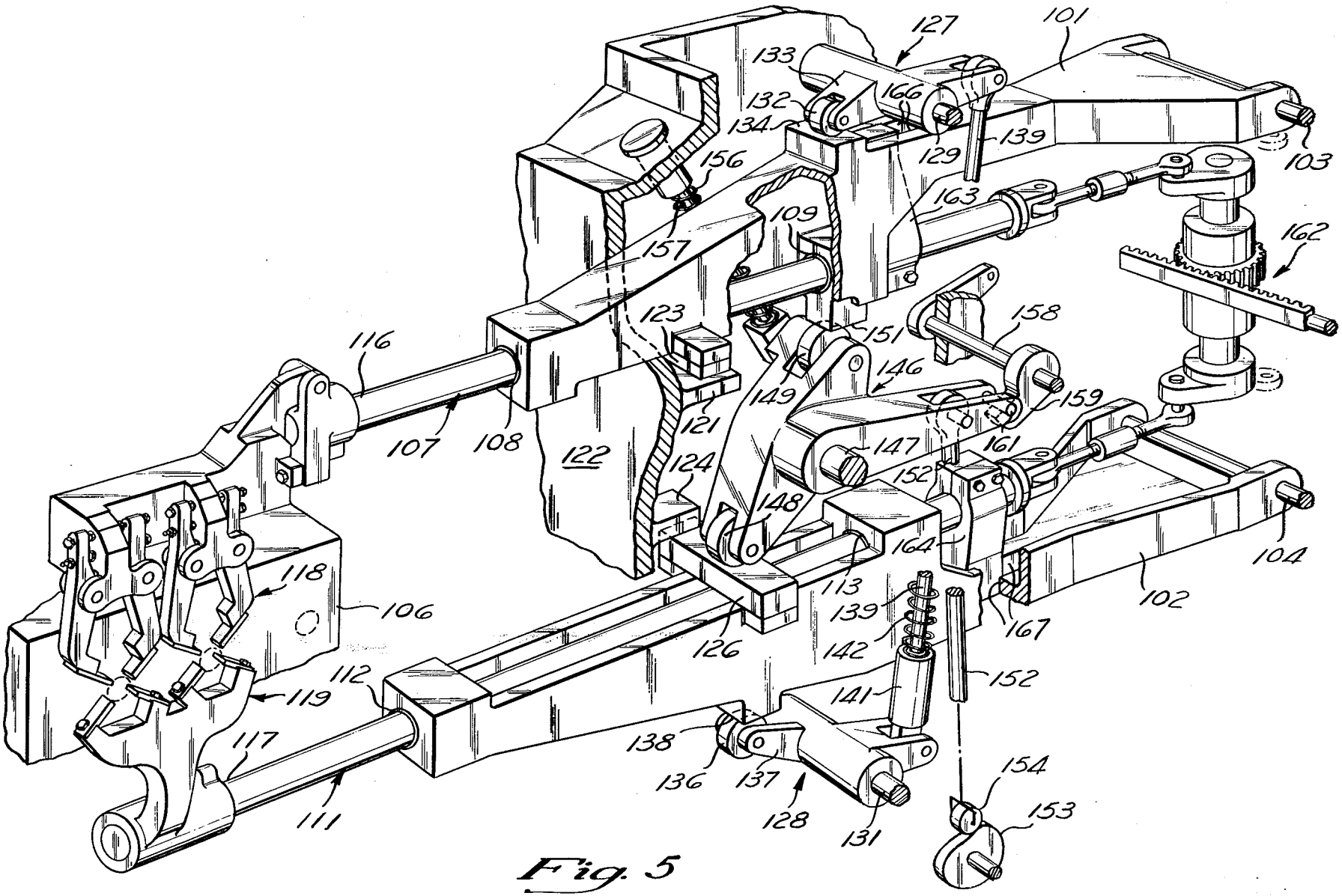
FIG. 5 is a perspective view of a transfer mechanism according to a second embodiment of this invention, with certain portions broken away or omitted for clarity.

In the second embodiment illustrated in FIG. 5, the same gripper assembly, as illustrated in the first embodiment, is utilized and the drive system for longitudinal movement of the transfer arms is the same as in the first embodiment. In the second embodiment, however, the structure for supporting the transfer arms and the drive mechanism for opening and closing the grippers differs from the first embodiment.

In the second embodiment, a pair of opposed support members 101 and 102 are pivoted on pivot shafts 103 and 104, respectively for oscillating rotation about the axes of the pivot shafts 103 and 104 which are parallel to each other and are perpendicular to the plane of the face of the die breast 106. Each of the support members 101 and 102 is formed with a trunion type structure at the pivot end to restrain the respective support members against any movement other than the pivotal movement about the respective axes.

Although this illustrated embodiment is provided with separate but parallel pivots for the two support members, it may in some instances be advisable to pivot both support members on a common pivot shaft. Therefore, as used herein, phrases such as parallel axes or parallel pivots is intended to include structures having common pivots or common pivot axes.

A transfer arm 107 of cylindrical shape is supported in spaced slide bearings 108 and 109 for lengthwise movement relative to the support member 101. Similarly, a transfer arm 111 is supported in spaced slide bearings 112 and 113 for lengthwise movement with respect to the support member 102. The two support arms extend in cantilever fashion to free end sections 116 and 117 on which are mounted opposed gripper mechanisms 118 and 119, respectively. The structure and operation of the gripper mechanisms 118 and 119 is the same as the corresponding mechanisms in the first embodiment, so the detailed description thereof is not repeated here.

A stop 121 is provided on the frame 122 to limit anti-clockwise rotation of the support member 101 beyond the illustrated positions when it engages a check plate 123 carried by the support member 101. Similarly, a stop 124 provided by the frame 122 is engageable with a check plate 126 carried by the support member 102 to limit clockwise movement of the support member beyond the position illustrated. When the two stop members 121 and 124 are engaged by the associated check plates, the two transfer arms 107 and 111 are parallel to each other.

A spring system is provided to resiliently bias the two support members 101 and 102 toward each other and toward engagement with the two stops. The spring system includes a pair of levers 127 and 128 mounted on pivot shafts 129 and 131, respectively. A roller 132 journaled on a projection 133 on the lever 127 is engageable with a surface 134 formed on the support member 101. Similarly, a roller 136 journaled on a projecting arm 137 of the lever 128 is engageable with a surface 138 on the support member 102. A compression spring system is connected to resiliently urge the lever 127 in an anti-clockwise direction and the lever 128 in a clockwise direction as viewed in FIG. 5. This spring system includes a rod 139 which extends into a tubular member 141 and a compression spring 142, which urges the rod 139 upwardly while urging the tubular member 141 downwardly. The rod 139 and tubular member 141 are respectively pivoted on projections on the levers 127 and 128 so that the action of the spring 142 biases the support member 101 toward engagement with the stop 121 and the support member 102 toward engagement with the stop 124.

The drive mechanism for opening the grippers includes a lever 146 pivoted between the two support members 101 and 102 for rotation about a pivot shaft 147. A first roller 148 is mounted on a projecting arm of the lever 146 for engagement with the check plate 126. A second roller 149 is journaled on another projection of the lever 146 for engagement with a surface 151 on the support member 101. Anti-clockwise rotation from the position illustrated in FIG. 5 causes the two rollers 148 and 149 to respectively move the two support arms 101 and 102 apart against the action of the spring 142. Conversely, clockwise rotation allows the spring 142 to return the support arms to their engagement with the two stops.

The operation of the lever 146 is provided by a drive rod 152 which is actuated by a cam 153 and a cam follower 154, both schematically illustrated in the drawing.

A compression spring 156 positioned around a rod 157 functions to apply a spring force to the lever 146, urging it in the clockwise direction. This spring maintains the cam follower 154 in engagement with its cam 153, and normally biases the lever 146 to a position it assumes when the two support arms are in engagement with their respective stops. The various elements are preferably proportioned so that clearance is provided between the two rollers 148 and 149 and their respective operating surfaces when the support arms are in engagement with the stops. Similarly, when desired the various elements are proportioned so that the action of the lever 146 commences the opening movement of the grippers 118 before movement of the grippers 119, as discussed above in connection with the first embodiment.

When it is desired to manually open the grippers, a shaft 158 is manually rotated to cause a cam 159 mounted thereon, to engage a cross pin 161, carried by the lever 146, to allow manual rotation of the lever in an anti-clockwise direction to open the grippers.

The longitudinal movement of the arms 107 and 111 is produced by a drive mechanism 162 which is the same as the drive mechanism illustrated in the first embodiment. Therefore, a detailed description of this mechanism is not repeated here.

A pair of guide members 163 and 164 are clamped onto the arms 107 and 111, respectively, and project between parallel guide surfaces 166 and 167 on the support members 101 and 102, respectively to prevent rotation of the two arms 107 and 111 about their respective axes.

With the structure of this embodiment, the two support members 101 and 102 are pivoted back and forth about their respective pivot axes to open and close the grippers. The movement of these arms is in a plane parallel to the plane of the face of the die breast 106. Because the amount of movement of the two support arms is relatively small, compared to the amount of movement at the free ends where the grippers are mounted, the inertia forces resulting from the opening and closing movement is less than in the first embodiment and higher speed operation can be obtained without encountering excessive bearing and drive forces. The extending and retracting movement of the two gripper support arms 107 and 111, under the influence of the drive 162, produces the back and forth movement of the grippers between adjacent die stations. The mechanism is arranged so that the two arms 107 and 111 are parallel when a workpiece is gripped by the two grippers and the workpiece transfer occurs with the arms parallel so that the movement of the arms 107 and 111 does not produce opening or closing movement of the grippers.

The operation of the mechanism is as follows. The arms 107 and 111 are extended while the support members are opened by the lever 146 to position the grippers to grip a workpiece as it is ejected from the dies. As the workpiece is ejected to the gripping position, the cam 153 allows the spring 142 to move the two support members inwardly against the stops and close the grippers on the workpiece. At the completion of the gripping operation, the drive 162 retracts the two arms 107 and 111 to position the workpiece adjacent to the subsequent die station. Release of the grippers is then accomplished by the action of the cam 153 through the movement of the lever 146 to open the two support members and cause the grippers to release. The support arms 107 and 111 are then extended by the drive 162 while in the open position to complete the cycle. The various drives are of course, timed to the operation of the basic machine and are usually mechanically interconverted with the machine drive to insure absolute synchronization of the various operation.

In both embodiments, the operating mechanisms are located away from the die stations and are enclosed to prevent damaging contamination or the like.

Although preferred embodiments of this invention are illustrated, it is to be understood that various modifications and rearrangements of parts may be resorted to without departing from the scope of the invention claimed herein.

What is claimed is:

1. A transfer for forging machines or the like comprising a frame, a pair of opposed assemblies with each assembly including a support member pivoted on said frame for arcuate movement about a pivot axes parallel to the pivot axes of the other support member, an elongated arm mounted on each support member for lengthwise movement relative to its associated support member, each elongated arm having a cantilever end section, workpiece grippers mounted on the end sections operable to grip a workpiece at one transfer location and to transport such workpiece to another transfer location, and drive means operable to pivot said assemblies about their respective pivot axes to open and close said grippers and to produce lengthwise movement of said arms to move said grippers between said transfer locations, the direction of said lengthwise movement of said arms being parallel when said grippers are closed on a workpiece, the mounting of each elongated arm on its associated support being at a support location to one side of said transfer locations in the direction of the length of said elongated arms, and said cantilever end sections extending from said support location to said transfer locations.

2. A transfer as set forth in claim 1 wherein said pivot axes are located at a point substantially spaced from both of said transfer locations, and a housing is provided to isolate substantially all of said transfer mechanism except for said grippers and said end sections from said transfer locations.

3. A transfer as set forth in claim 1 wherein said two transfer locations are horizontally spaced, and said pivot of said support members are horizontal and substantially spaced from said transfer locations, said arms extending generally horizontal and being supported at a position horizontally spaced to one side of said locations.

4. A transfer as set forth in claim 1 wherein said elongated arms are circular in cross section, and guide means are provided to prevent rotation of said arms about their longitudinal axes.

5. A transfer as set forth in claim 4 wherein said pivot axes of said support members are substantially perpendicular to said direction of lengthwise movement and are spaced to one side of said transfer locations.

6. A transfer as set forth in claim 5 wherein said drive means include a lever pivoted between said members, rotation of said lever about its pivot axes causing said support members to pivot toward and away from each other.

7. A transfer as set forth in claim 1 wherein spring means resiliently bias said support members for gripping a workpiece by said gripper means, and said drive means is connected to overcome said spring means to release said grippers.

8. A transfer as set forth in claim 1 wherein said longitudinal arms are circular in cross section, and guide means are connected to said arms to maintain the movement of the workpiece gripping portions of said workpiece grippers substantially along a plane as said grippers grip and release a workpiece.

9. A transfer as set forth in claim 8 wherein said pivot axes of said support members are substantially parallel to said direction of lengthwise movement.

10. A transfer as set forth in claim 8 wherein said pivot axes of said support members are substantially perpendicular to said direction of lengthwise movement.

11. A workpiece forging machine or the like having a die bed providing a plurality of die stations spaced therealong in a direction of transfer, a transfer mechanism operable to progressively transfer workpieces in said direction of transfer between said die stations, said transfer mechanism including a pair of opposed assemblies each pivoted at locations spaced from said die stations for arcuate movement about axes which are parallel to each other, each assembly including an elongated arm supported laterally to one side of said dies for lengthwise movement and providing a cantilever end section extending to a location adjacent to said die stations, cooperating workpiece grippers mounted on said end sections of each arm, a first drive operable to pivot said assemblies about their respective pivots in opposite directions to move said grippers toward and away from each other for gripping and releasing a workpiece, a second drive operable to simultaneously move said arms in the direction of their length to cause said grippers to move back and forth between adjacent die stations, said lengthwise movement of each arm being parallel to said transferred direction when said grippers grip and transfer a workpiece between said die stations.

12. A workpiece forging machine as set forth in claim 11 wherein a housing is provided to isolate substantially all of said transfer mechanism excepting for said grippers and said end sections from said die stations to prevent contamination thereof.

13. A workpiece forging machine as set forth in claim 11 wherein said pivot axes of said assemblies are substantially parallel to said direction of transfer and are located on opposite sides of said die stations.

14. A workpiece forging machine as set forth in claim 11 wherein said pivot axes of said assemblies are substantially perpendicular to said direction of transfer and are located to one side of said die stations in said direction of transfer.

15. In a clockwise forging machine having a die breast provided with a plurality of laterally spaced die stations, a transfer assembly operable to progressively transfer workpieces laterally between said die stations, said transfer assembly including first and second transfer arms, means mounting said transfer arms for arcuate translation about parallel axes spaced from said die stations, means to drive said transfer arms through said arcuate translation toward and away from each other, workpiece gripping means supported and carried by each transfer arm and having finger end portions operable to grip workpieces at each die station as said transfer arms are translated toward each other, means for guiding each of said finger end portions substantially parallel to the plane of said die breast during the arcuate translation of said transfer arms, and means for translating said gripping means laterally between adjacent die stations.

16. A workpiece forging machine according to claim 15 wherein said axes are defined by parallel shafts and wherein said means mounting said transfer arms for arcuate translation comprise links journaled to the transfer arms and carried by said shafts.

17. A workpiece forging machine according to claim 16 wherein a link connects each arm to each shaft and wherein each of said links comprises a bell crank arm pivotally connected to the other bell crank arm to cause arcuate translation of said transfer arms toward and away from each other.

18. A workpiece forging machine according to claim 17 wherein said means to drive said transfer arms through said arcuate translation comprises a rod pivotally connected to one of said bell crank arms.

19. A workpiece forging machine according to claim 18 wherein said transfer arms are biased toward each other.

20. A workpiece forging machine according to claim 15 wherein said means for guiding said finger end portions comprises first and second arms respectively fixed to said first and second transfer arms and projecting toward each other, the projecting ends of said arms being received by guide means operable to guide the projecting ends of said arms in planes parallel to the plane of said die breast upon arcuate translation of said transfer arms.

21. A workpiece forging machine according to claim 20 wherein the ends of said projecting arms are provided with blocks pivoted thereto and wherein said blocks are slidable between plates having faces parallel to the plane of said die breast.

22. A workpiece forging machine according to claim 21 wherein said blocks are positioned closely adjacent to the plane of said die breast.

23. A workpiece forging machine according to claim 15 wherein said means for translating said gripping means laterally between adjacent die stations comprises first and second rods respectively pivotally connected at one end to said first and second transfer arm means and pivotally connected at their other ends to first and second crank arms, said crank arms being mounted at the ends of a cross shaft and said cross shaft carrying a spur gear thereon which is engaged by a driving gear rack.

24. A workpiece forging machine according to claim 23 wherein the pivotal connection between said first and second rods and said first and second transfer arms means comprises self-aligning bearing means.

25. A workpiece forging machine according to claim 15 wherein said transfer arms are surrounded by housing means.

26. A workpiece forging machine according to claim 15 wherein the finger end portions on said first transfer arm are biased toward each other.

27. A workpiece forging machine according to claim 26 wherein means are provided to move said first transfer arm away from said second transfer arm prior to movement of said second transfer arm.

28. In a workpiece forging machine having a die breast provided with a plurality of laterally spaced die stations, a transfer assembly operable to progressively transfer workpieces laterally between said die stations, said transfer assembly including first and second transfer arms positioned closely adjacent to the plane of the die breast, means mounting said transfer arms for arcuate translation about parallel axes spaced from said die stations, means to drive said transfer arms through said arcuate translation toward and away from each other, workpiece gripping means carried by each transfer arm and having finger end portions operable to grip workpieces at each die station as said transfer arms are translated toward each other, means for guiding said finger end portions substantially parallel to the plane of said die breast during the arcuate translation of said transfer arms, said means for guiding said finger end portions comprising first and second projections respectively fixed to said first and second transfer arms being received by guide means operable to guide the projecting ends of said arms in planes parallel to the plane of said die breast upon arcuate translation of said transfer projections, and means for translating said gripping means laterally between adjacent die stations.

29. A workpiece forging machine according to claim 28 wherein said axes are defined by parallel shafts and wherein said means mounting said transfer arms for arcuate translation comprise links journaled to the transfer arms and carried by said shafts.

30. A workpiece forging machine according to claim 29 wherein a link connects each arm to each shaft and wherein each of said links comprises a bell crank arm pivotally connected to the other bell crank arm to cause arcuate translation of said transfer arms toward and away from each other.

31. A workpiece forging machine according to claim 28 wherein a workpiece gripping means is hinged to its transfer arm so that it may be swung away from said die breast for access to said die stations.

* * * * *

UNITED STATES PATENT AND TRADEMARK OFFICE

CERTIFICATE OF CORRECTION

PATENT NO. : 3,965,718

DATED : June 29, 1976

INVENTOR(S) : Gaylen O. Kline

It is certified that error appears in the above-identified patent and that said Letters Patent are hereby corrected as shown below:

Column 1, line 23, "station" should read --stations--.

Column 1, line 41 "teed" should read --ted--.

Column 2, line 28, "guide" should read --guides--.

Column 2, line 42, "times" should read --timed--.

Column 3, line 62 "in" should be deleted.

Column 3, line 63, "to" , second occurrence, should be -- of --.

Column 4, line 3, "these" should read --those--.

Column 4, line 13, "repectively" should read --respectively--.

Column 5, line 65 "translated the arces" should read --translated along the arcs--.

Column 6, line 33, "crank 23" should read --crank arm 23--.

Column 6, line 53, "the" should read --The--.

Column 9, line 45, "interconverted" should read --interconnected-

UNITED STATES PATENT AND TRADEMARK OFFICE

CERTIFICATE OF CORRECTION

PATENT NO. : 3,965,718

DATED : June 29, 1976

INVENTOR(S) : Gaylen O. Kline

It is certified that error appears in the above-identified patent and that said Letters Patent are hereby corrected as shown below:

Column 10, line 32, "said members" should read --said support members--.

Column 11, line 25, "In a clockwise forging" should read --In a workpiece forging--.

Column 12, line 19, "transfer arms" should read --transfer arm--.

Column 12, line 50, "said arms" should read --said projections--.

Column 12, line 52, "transfer projections" should read --transfer arms--.

Signed and Sealed this

Sixteenth Day of November 1976

[SEAL]

*Attest:*

RUTH C. MASON
*Attesting Officer*

C. MARSHALL DANN
*Commissioner of Patents and Trademarks*